United States Patent [19]

Gorodissky et al.

[11] 4,136,536

[45] Jan. 30, 1979

[54] HERMETIC SEAL OF A CHAMBER FOR TREATMENT OF BANDLIKE MATERIAL AT AN EXCESS PRESSURE

[76] Inventors: Leonid G. Gorodissky, Dmitrovskoe shosse, 153/43, kv. 106; Raisa V. Vasilieva, Nizhnyaya Maslovka, 18, kv. 95; Mikhail D. Kozlov, Matveevskaya ulitsa, 1, kv. 331, all of Moscow, U.S.S.R.; Nikolai T. Romanov, deceased, late of Moscow, U.S.S.R., by Anastasia I. Romanova, administrator, Bulatnikovsky proezd, 14, korpus 5, kv. 152, Moscow, U.S.S.R.

[21] Appl. No.: 871,464

[22] Filed: Jan. 23, 1978

[51] Int. Cl.[2] ..... D06B 23/18

[52] U.S. Cl. ..... 68/5 E; 34/242

[58] Field of Search ..... 68/5 E; 34/242

[56] References Cited

U.S. PATENT DOCUMENTS

| | | | |
|---|---|---|---|
| 3,302,432 | 2/1967 | Woollatt et al. | 68/5 E |
| 3,343,379 | 9/1967 | Duis et al. | 68/5 E |
| 4,017,258 | 4/1977 | Sando et al. | 68/5 E X |
| 4,064,582 | 12/1977 | Sando et al. | 68/5 E X |

*Primary Examiner*—Philip R. Coe

*Attorney, Agent, or Firm*—Steinberg & Blake

[57] ABSTRACT

The present invention relates to sealing devices and is most expedient to be applied in dyeing-and-finishing processes involved in textile industry. The hermetic seal of the chamber for treatment of bandlike material at an excess pressure has a hollow shell accommodating a pair of driving rollers for traversing the material under treatment, and a sealing device which hermetically divides, along with the rollers, the shell interior into an excess pressure zone communicating with the chamber, and an atmospheric pressure zone communicating with the atmosphere. According to the invention, communication between the atmospheric-pressure zone and the atmosphere is established through the agency of a check valve provided in the shell and made as a flexible sleeve whose bore is adapted for the bandlike material under treatment to freely pass. Such a constructional arrangement provides for reliable hermetic sealing of the chamber for treating bandlike material under an excess pressure.

7 Claims, 5 Drawing Figures

HERMETIC SEAL OF A CHAMBER FOR TREATMENT OF BANDLIKE MATERIAL AT AN EXCESS PRESSURE

The present invention relates generally to hermetic sealing devices and more specifically, to hermetic seals of a chamber for treatment of bandlike material at an excess pressure.

The invention can find most utility when applied in dyeing-and-finishing processes involved in textile industry, viz., in chambers for high-temperature treatment of textiles in steam or water.

Known in the prior art are hermetic seals of a chamber for treatment of bandlike material at an excess pressure (cf. U.S. Pat. No. 3,320,776 Cl.68-5), each having a hollow shell accommodating a pair of driving rollers adapted for the material under treatment to traverse, and a sealing device which hermetically divides, along with the rollers, the interior space of the shell into an excess pressure zone communicated with the chamber and an atmospheric pressure zone communicated with the atmosphere.

In the known prior-art hermetic seals the hollow shell is shaped as a cylinder adapted for the material under treatment to pass therethrough in the direction square with its longitudinal axis. With this purpose in view the cylinder-shaped shell has two diametrically opposed throats, through one of which the seal interior communicates with the chamber for treatment of the material and through the other throat, with the atmosphere. The driving rollers for the material to traverse are rubber-faced and snugly adjoin one another along the generating line and to the sealing device. The rollers are exposed to the effect of excess pressure and elevated temperatures on the side of said chamber, which might lead to destruction of their rubber lining. The result is the disturbed tightness of isolation between said zones the seal interior is subdivided into and, consequently, the hermetic sealing of the chamber. Thus, steam under pressure is free to escape from the chamber through the seal and create dangerous situation for the attending personnel.

It is an essential object of the present invention to provide such a hermetic seal that would provide tightness of the chamber and its reliable operation.

Said and other objects of the present invention are attained due to the provision of a hermetic seal of a chamber for treatment of bandlike material at an excess pressure, a hollow shell of which accommodates a pair of driving rollers adapted for the material under treatment to traverse, and a sealing device adapted to hermetically divide, along with the rollers, the interior of the seal into an excess pressure zone communicated with the chamber and an atmospheric pressure zone communicated with the atmosphere, wherein according to the invention communication between the atmospheric pressure zone and the atmosphere is established through the agency of a check valve provided inside the shell and made essentially as a flexible sleeve whose bore is adapted for the bandlike material under treatment to pass freely therethrough.

Such a constructional arrangement provides for a reliable closing of the seal in the case of failed hermetic isolation between the aforesaid zones defined in the interior of the seal shell and increased pressure in the atmospheric pressure zone, thereby maintaining a preset degree of hermetic sealing of the chamber for treatment of bandlike material. This is of paramount importance in case of failure of rubber lining of the driving rollers. Apart from that, provision of a check valve enables one to preclude steam ejection from the seal which fully rules out any emergency situation. Provision of the check valve as a flexible sleeve renders the valve more sensitive to a relatively negligible pressure rise within the atmospheric pressure zone of the seal which obviates also even partial loss of sealing of the chamber and makes it reliable in operation.

It is expedient that the flexible sleeve should be defined by two plates interconnected with their side edges and that inserts be interposed between the plates nearby the joints thereof so as to impart a slitlike shape to the sleeve passageway.

The sleeve of such a construction is simple in manufacture, features adequate elasticity which provides for a necessary sensitivity of the check valve to relatively low pressure differential values and reliable tightness of the seal and thereby of the chamber as a whole. Besides, such a sleeve is of the fast-response time whereby the check valve gets closed within a rather short lapse of time.

According to one of the embodiments of the invention the plates are made of a rubbery material and their side edges are adhesive-bonded and held together by way of cover strips provided nearby the ends of the plates on the outer side thereof. In addition, the inserts have lanceolate cross-sectional shape.

Such an embodiment of the flexible sleeve with the inserts establishes free and unobstructed passage of the material under treatment therethrough and alongside therewith provides for a reliable closing of the sleeve bore in case of necessity.

According to another embodiment of the present invention, the plates are made in metal and their side edges are interconnected by virtue of elastic cuffs shaped cross-sectionally as a trident whose central prong serves as an insert.

Provision of the flexible sleeve plates made in metal ensures reliable operation of the check valve when the seal assumes the horizontal position. In this case the central prong of the cuff serving as an insert provides free passing of the material through the passageway of the check valve and at the same time enables reliable closing of the bore in case of excess pressure developed within the atmospheric pressure zone of the seal.

It is expedient that the ends of the flexible sleeve should be reinforced. Such a reinforcement of the vacant end of the flexible sleeve provides for retaining of the rectilinear shape of the walls of the slitlike passageway in the cross section thereof which conduces to a free passing of the material treatment therethrough.

It is likewise beneficial that the seal should incorporate a device for a positive closing of the passageway of the flexible sleeve, made as a swivel frame located on the outer side thereof nearby its middle (as to length) portion.

Provision of such a device enables one to close the check valve when it becomes necessary to upset hermetic separation of the atmospheric- and excess-pressure zones defined inside the interior of the seal shell.

A specific and preferred embodiment of the present invention is proposed herein by way of example referred to a hermetic seal of a chamber for treatment of bandlike material, such as textile. However, it should be borne in mind that the field of application of the present invention is by no means bounded to the aforesaid specific embodiment thereof.

Given below is a detailed description of a possible embodiment of the present invention with reference to the accompanying drawings, wherein.

Figure 1:
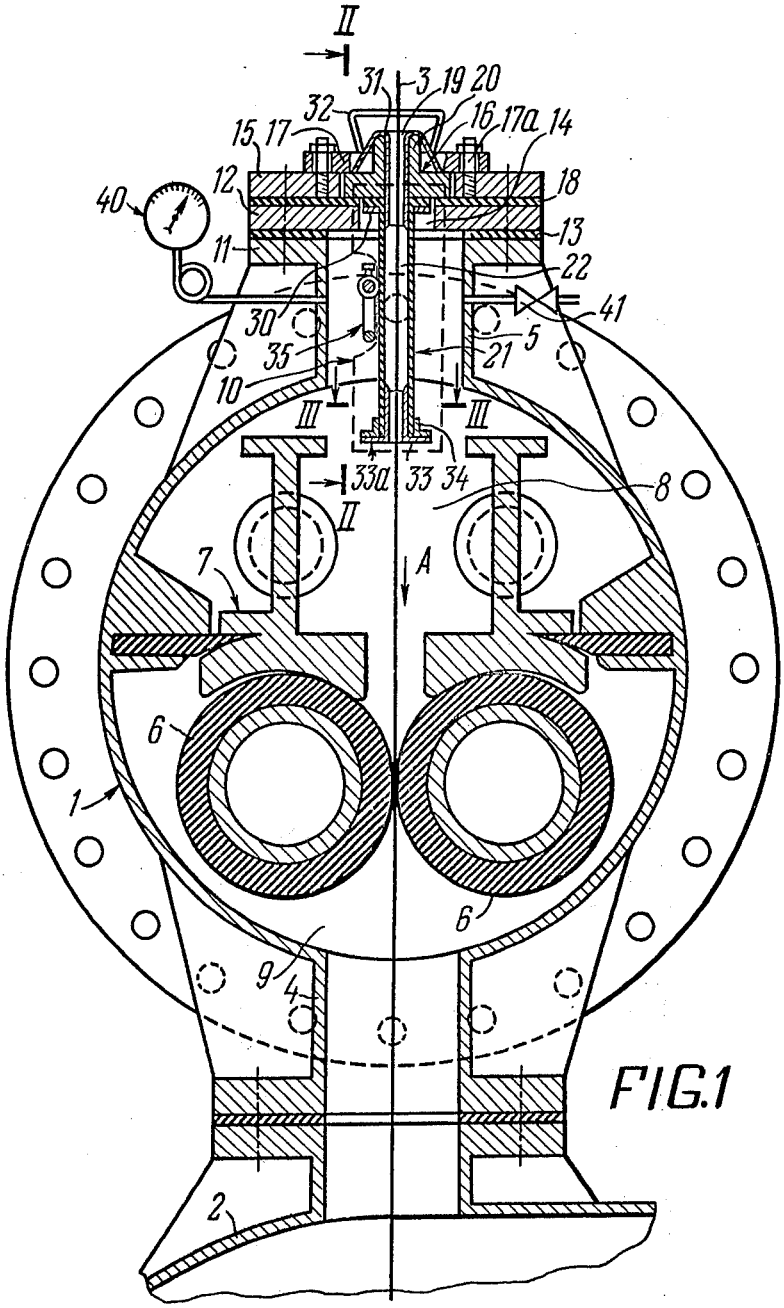
FIG. 1 is a schematic cross-section view of a hermetic seal of a chamber for treatment of bandlike material at an excess pressure, according to the invention.

The hermetic seal of a chamber for treating bandlike material, such as textile, at an excess pressure has a hollow shell 1 (FIG. 1) mounted on a chamber 2 for treating a textile 3. The hollow shell 1 is shaped as a horizontally arranged cylinder.

The cylindrical surface of the shell 1 has two coaxial throats 4 and 5 arranged diametrically opposite to each other. The portways of the throats 4 and 5 are rightangular in shape and are arranged lengthwise the generator line of the shell 1 so as to be adapted for the textile 3 under treatment to pass freely therethrough. The throat 4 adjoins the throat of the chamber 2.

The hollow shell 1 accommodates a pair of driving rollers 6 for the textile 3 under treatment to traverse, and a sealing device. The device 7 along with the rollers 6 hermetically divides the interior of the shell 1 into an atmospheric pressure zone 8 communicated with the atmosphere through the throat 5, and an excess pressure zone 9 permanently communicated with the chamber 2 through the throat 4 and located under the sealing device 7.

According to the invention, a check valve 10 is provided in the shell 1 of the hermetic seal, adapted for establishing communication between the atmospheric pressure zone 8 and the atmosphere.

Figure 2:
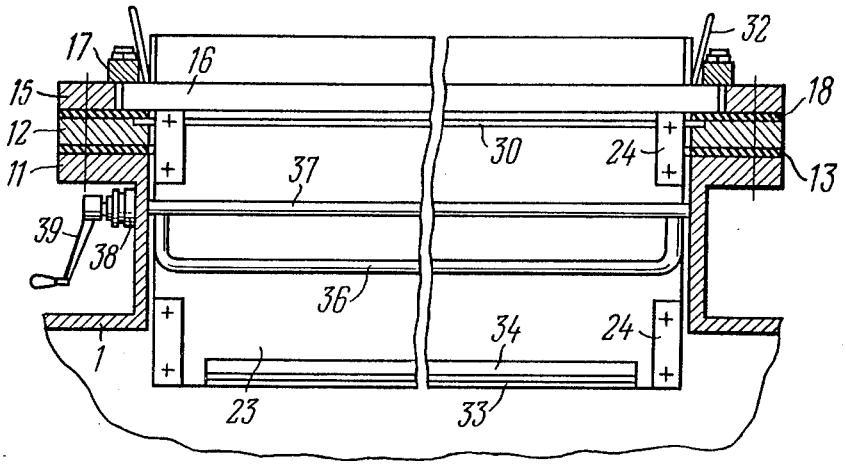
FIG. 2 is a section taken along the line II—II in FIG. 1.

The check valve 10 is situated in the throat 5 of the shell 1. The throat 5 has a flange 11 (as shown in FIG. 1) to which cover 12 is held rigidly, a sealing gasket being interposed between the flange 11 and the cover 12. The cover 12 has a centre portway 14 similar in shape to the portway of the throat 5 and carries a frame 15 whose outside contour coincides with that of the cover 12, both the frame 15 and the cover 12 are held to the flange 11 by common bolts (not shown). An insert 16 is accommodated inside the frame 15 and forced against the cover 12 by two strips 17 as shown in FIGS. 1 and 2. The strips 17 are locked-in with the frame 15 by bolts 17a. Interposed between the frame 15 and the cover 12 is a sealing gasket 18 provided with a centre hole 19 coinciding with the centre portway 14 of the cover 12. The gasket 18 is forced by the insert 16 against the cover 12 as shown in FIG. 1.

The insert 16 has an open-end centre portway 19 for the textile 3 under treatment to pass through, said portway 19 being slitlike in shape. Stiffening ribs 20 are provided in the insert 16, spaced along the periphery of its centre portway 19 as shown in FIG. 1.

According to the invention, the check valve 10 is shaped as a flexible sleeve 21 having a passageway 22 for the textile 3 under treatment to pass through.

The sleeve 21 is arranged vertically and is established by two plates 23 (FIG. 3) rectangular in shape and interconnected by their side edges.

Figure 3:
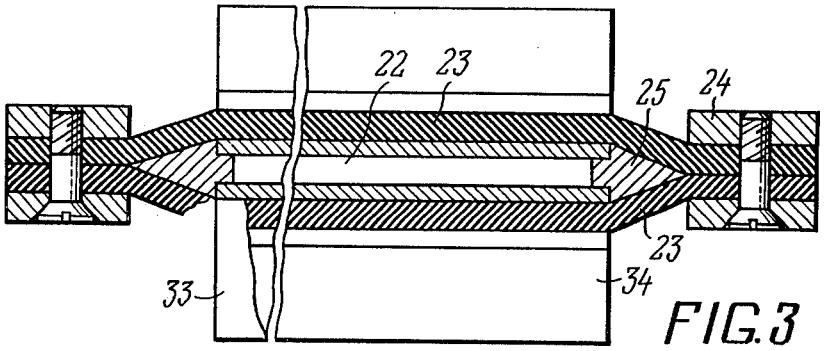
FIG. 3 is a scaled-up view of a section taken along the line III—III in FIG. 1, showing one of the possible embodiments of a flexible sleeve of the check valve, according to the invention.

According to one of the embodiments of the present invention, the plates 23 of the check valve 10 (the passageway 22 of which gets closed at an excess pressure within about 0.1 kgf/cm$^2$) are made in a rubber-like material, are adhesive-bonded to each other throughout the entire length of their side edges and held together through four pairs of cover straps 24 (FIG. 2). The cover straps 24 are provided close to the top and bottom ends of each plate 23 on its outer side (as shown in FIG. 2) and are held in pairs, thus securing the plates 23 as illustrated in FIG. 3.

According to the invention, the passageway 22 of the sleeve 21 is adapted for the bandlike material under treatment to pass freely therethrough. To this end, four inserts 25 (FIG. 3) are interposed between the plates 23 nearby the places where they are interconnected through the cover straps 24 so as to impart slitlike shape to the passageway 22. Each of the inserts 25 is lancet-shaped in its cross-section, its lanceolated end facing towards the joined-together edges of the plates 23 as shown in FIG. 3.

According to another embodiment of the invention, the plates 23 are made of metal sheets, such stainless steel, titanium, etc. Such plates are made use of in the check valves 10 whose passageway 22 has to be closed at an excess pressure within 0.1 to 0.5 kgf/cm$^2$. The thickness of the plates 23 is adopted to be within 1 to 3 mm.

Figure 4:
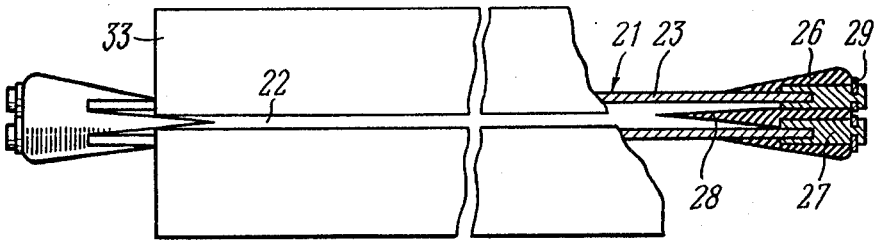
FIG. 4 illustrates another embodiment of a flexible sleeve of the check valve, according to the invention.

The metal plates 23 of the flexible sleeve 21 are held together with their side edges by way of elastic (say, rubber), cuffs 26 (FIG. 4), rods 27 being fixed in position at the side edges of each plate 23 close to its top and bottom ends. Each of the rods 27 has an axial slot located at either of its ends, with which slot said rod is engaged with the edge of the plate 23 (as shown in FIG. 4) and is held in place thereto. The rubber cuffs 26 are cross-sectionally shaped as a trident, the side edges of the plates 23 being arranged in between the prongs of each of the cuffs 26 as shown in FIG. 4. A central prong 28 of each of the cuffs 26 is situated between the metal plates 23 and serves as an insert establishing a slitlike shape of the passageway 22 and a free passing of the textile 3 under treatment therethrough.

Each of the cuffs 26 has holes made in its base between the prongs of the trident (as shown in FIG. 4), with which the cuff is put on the rods 27 provided at the edges of the plates 23 facing the same side. Each of the rods 27 has an annular recess located close to the rod vacant end and adapted for a snap ring 29 to accommodate. Said rings 29 are located outside the cuffs 26 (as shown in FIG. 4) so as to hold the cuffs 26 to the rods 27.

The flexible sleeve 21 (FIG. 1) with its top end is secured on the insert 16 on the side of the atmospheric pressure zone 8 of the interior of the shell 1. The edges of the plates 23 are flanged outwards and pressed against the surface of the insert 16 by strips 30 which are fixed in place thereon as shown in FIG. 1.

Two guide plates 31 are provided in the portway 19 of the insert 16, the top end of each of said guide plates 31 being so bent as to embrace the corresponding stiffening rib 20 of the insert 16 as shown in FIG. 1, whereas the bottom ends of the plates 31 are accommodated in the passageway 22 of the sleeve 21, thus reinforcing the top end of the sleeve 21 and keeping the plates 23 (FIG. 3) against being brought together in the top portion of the passageway 22 of the sleeve 21, to ensure free passing of the textile 3 under treatment through the sleeve 21.

Two handgrips 32 are provided on the insert 16 on the side of the stiffening ribs 20 thereof as shown in FIGS. 1 and 2.

The handgrips 32 are provided for the sake of convenience in setting the insert in or out of position along with the check valve 10 made fast thereon, in the course of the seal installation.

According to the invention, the bottom end of the flexible sleeve 21 is likewise reinforced. To this aim, the bottom end of each of the plate 23 carries a pair of cleats 33 and 34 (FIG. 1), which are shaped as angles whose flanges are mutually perpendicular. The cleats 33 and 34 are put one into the other and held rigidly together so that the bottom edge of each of the plates 23 is gripped between their vertical flanges. The cleats 33 and 34 are somewhat shorter than the width of the plates 23 as shown in FIGS. 2 and 3.

In addition, the horizontal surface defined by the cleats serve as a platform 33*a* acted upon by the dynamic pressure developed by the working fluid escaping from the chamber which makes the valve to operate instantaneously.

According to the invention, provision is made in the hermetic seal of the invention for a device 35 (FIG. 1) for a positively closing the passageway 22 of the flexible sleeve 21. The device 35 is accommodated in the top throat 5 and is made as a swivel frame 36 (FIG. 2) located outside the flexible sleeve 21 close to the middle (as to length) portion thereof. The frame 36 is made from a bar stock bent as shown in FIG. 2 and fixed in place with its ends on a shaft 37. Said shaft 37 is arranged horizontally parallel to the plates 23 and is mounted rotatably round its own axis in the throat 5 of the shell 1. The shaft 37 is held with its one end to the wall of the throat 5, while the other end of the shaft is passed through the hole in the throat opposite wall, sealed with a gland 38 of any conventional type suitable for the purpose and has a handgrip 39 for the shaft 37 to rotate manually.

A pressure gauge 40 is built into the wall of the throat 5 (FIG. 1) and is communicated with the atmospheric pressure zone 8 of the interior of the shell 1; apart from it a globe valve 41 is provided there to communicate the atmospheric pressure zone 8 with the atmosphere when the check valve 10 is closed.

The hermetic seal of a chamber for treatment of bandlike material at an excess pressure operates as follows.

Figure 5:
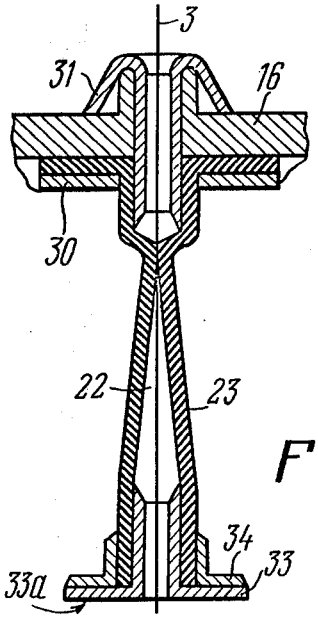
FIG. 5 is a scaled-up longitudinal-section view of the check valve shown at the instance where its passageway is closed.

When guiding the textile material 3 into the chamber 2 the driving rollers 6 are brought apart radially. The textile 3 is passed between the rollers through the portway 19 of the insert 16, via the passageway 22 of the check valve 10, across the gap between the rollers 6 and further on through the throat 4 into the chamber 2. Next the rollers 6 are brought together till contacting each other so that the textile 3 get gripped therebetween. In the course of treatment the textile 3 is traversed by the rollers 6 in the direction facing the arrow A. Then pressure inside the chamber 2 is raised to a specified level, with the result that the same pressure is established within the excess pressure zone 9 of the shell 1 interior. The sealing device 7 along with the rollers 6 tightly forced thereagainst provides for reliable hermetic sealing of the excess pressure zone 9 and, consequently that of the chamber 2. The atmospheric pressure zone 8 of the shell 1 interior is communicated with the atmosphere through the passageway 22 of the check valve 10. When the hermetic sealing of the excess pressure zone 9 is disturbed, which is the case, say, when the rubber lining of the rollers 6 is destructed, the gaseous working fluid is free to rush from the chamber 2 through the excess pressure zone 9 into the atmospheric pressure zone 8 to exert effect (dynamic pressure) upon the horizontal platform 33*a* made up by the cleats 33. As a result, the flexible sleeve 21 gets bent, whereby its plates 23 are brought together to close the passageway 22. A sharp pressure rise within the zone 8 thus ensues. Further on, the static pressure developed in the zone 8 starts exerting upon the plates 23 as soon as it reaches the maximum admissible level. The plates 23 get bent nearby the ends of the guide plates 31 (as shown in FIG. 5) to close the passageway 22 of the check valve 10. As a result, the vacant end of the check valve 10 is returned to the initial position.

The pressure gauge 40 (FIG. 1) communicated with the zone 8, gives a signal to stop the rollers 6, whereupon the globe valve 41 is to be opened to establish communication of the zone 8 with the atmosphere. The check valve 10 assumes the initial position, thus releasing the textile gripped in between its plates 23. The cause of failure of the hermetic sealing of the zone 9 having been eliminated, the seal is ready for further operation.

Whenever it is necessary to establish an excess pressure in the chamber 2 with the rollers 6 brought apart and rotating, the check valve 10 is closed by virtue of the device 35. To this end, the handgrip 39 (FIG. 2) is turned counterclockwise (in the plane of FIG. 1) together with the shaft 37 on which the swivel frame 36 is fixed in position. While being turned, the frame 36 forces the nearest plate 23 against the other plate 23 of the check valve 10. Thus, the plates 23 approximate each other to close the passageway 22. Further operation of the check valve 10 is similar to that described hereinbefore.

It will be understood that some alterations may be introduced into the construction of the hermetic seal of a chamber for treatment of bandlike material at an excess pressure that has hereinbefore been described only as a specific exemplary embodiment of the invention not bounding it in details, provided such changes fall within the scope of the present invention.

What is claimed is:

1. A hermetic seal of a chamber for treatment of bandlike material at an excess pressure, comprising: a hollow shell; a pair of driving rollers for traversing the bandlike material under treatment, said rollers being accommodated in said hollow shell; a sealing device housed in said hollow shell; and excess pressure zone within said hollow shell, said zone being located under said sealing device and communicated with the chamber; an atmospheric pressure zone defined within said hollow shell, said zone being communicated with the atmosphere and being hermetically isolated from said excess pressure zone through said sealing device along with said pair of driving rollers; a check valve mounted in said hollow shell to establish communication between said atmospheric pressure zone with the atmosphere; said check valve being fashioned as a flexible sleeve; the passageway of said flexible sleeve adapted for the band-like material under treatment to pass freely.

2. A hermetic seal as claimed in claim 1, wherein the flexible sleeve comprises: two plates interconnected by their side edges; inserts interposed between said plates close to the joints therebetween so as to impart a slitlike shape to the passageway of the flexible sleeve.

3. A hermetic seal as claimed in claim 2, wherein said plates are made from a rubber-like material, are adhesive-bonded together with their side edges, said side edges of said plates being held to each other by cover straps provided on the outer side of the plates close to the ends thereof.

4. A hermetic seal as claimed in claim 2, wherein the flexible sleeve comprises said inserts having lanceolate cross-sectional shape and with their pointed end facing the side edges of the plates.

5. A hermetic seal as claimed in claim 2, comprising: plates made of metal; elastic cuffs interconnecting the side edges of said plates and having tridentate cross-sectional shape, the central prong of said tridentate cuffs serving as an insert.

6. A hermetic seal as claimed in claim 1, wherein said flexible sleeve is provided with reinforced ends.

7. A hermetic seal as claimed in claim 1, comprising a device for positively closing the passageway of the flexible sleeve, said device being made as a swivel frame situated outside said flexible sleeve close to the center portion thereof.

* * * * *